US008604705B2

(12) United States Patent
Ko et al.

(10) Patent No.: US 8,604,705 B2
(45) Date of Patent: Dec. 10, 2013

(54) COMPENSATION CIRCUIT OF ORGANIC LIGHT EMITTING DIODE

(75) Inventors: Chien-Chuan Ko, Shengang Township (TW); Chao-Hui Wu, Kaohsiung (TW)

(73) Assignee: Hannstar Display Corporation, New Taipei (TW)

( * ) Notice: Subject to any disclaimer, the term of this patent is extended or adjusted under 35 U.S.C. 154(b) by 148 days.

(21) Appl. No.: 13/359,149

(22) Filed: Jan. 26, 2012

(65) Prior Publication Data

US 2013/0043796 A1 Feb. 21, 2013

(30) Foreign Application Priority Data

Aug. 16, 2011 (TW) ..... 100129312 A

(51) Int. Cl.
*G09G 3/10* (2006.01)

(52) U.S. Cl.
USPC ..... 315/169.3; 315/169.1; 315/169.4; 345/76; 345/82

(58) Field of Classification Search
None
See application file for complete search history.

(56) References Cited

U.S. PATENT DOCUMENTS

| | | | | |
|---|---|---|---|---|
| 8,207,918 | B2 * | 6/2012 | Kohno et al. | 345/78 |
| 2004/0252089 | A1 * | 12/2004 | Ono et al. | 345/82 |
| 2005/0285826 | A1 * | 12/2005 | Park et al. | 345/76 |

* cited by examiner

*Primary Examiner* — Anh Tran
(74) *Attorney, Agent, or Firm* — Jianq Chyun IP Office

(57) ABSTRACT

A compensation circuit of organic light emitting diode comprising a first capacitor, a second capacitor, a stabilizer unit, a third transistor, an organic light emitting diode and a driver unit. The stabilizer unit comprises a first transistor, a second transistor and a photodiode. The driver unit comprises a fourth transistor, a fifth transistor and a sixth transistor. The fifth transistor is used for driving the organic light emitting diode. The first transistor, the second transistor, the third transistor, the fourth transistor and the sixth transistor are used as switches. The first capacitor is used as a compensation capacitor. The second capacitor is used for storing a data voltage. By controlling a voltage of a node in the circuit, the current of the organic light emitting diode can be increased to maintain a stable brightness of the organic light emitting diode.

19 Claims, 9 Drawing Sheets

COMPENSATION CIRCUIT OF ORGANIC LIGHT EMITTING DIODE

CROSS-REFERENCE TO RELATED APPLICATION

This application claims the benefit of priority to Taiwan Patent Application No. 100129312, filed on Aug. 16, 2011, in the Taiwan Intellectual Property Office, the disclosure of which is incorporated herein in its entirety by reference.

BACKGROUND OF THE INVENTION

1. Field of the Invention

The present invention relates to a compensation circuit of an organic light emitting diode, in particular to the compensation circuit capable of maintaining a stable brightness of the organic light emitting diode.

2. Description of the Related Art

Active-matrix organic light-emitting diode (AMOLED) display device featuring thin thickness, light weight, self-luminescence, low driving voltage, high efficiency, high contrast, high color saturation, quick response speed, and high flexibility is considered as the most promising rising display technology after the development of thin film transistor liquid crystal display device (TFT-LCD).

Since the brightness of the organic light emitting diode (OLED) components depends on the magnitude of current, it is necessary to control the current accurately in order to control pixel brightness accurately, thus incurring a much higher level of difficulty than the conventional TFT-LCD that controls the pixel brightness by controlling the voltage level of writing in pixels only.

In fact, the AMOLED also encounters many problems. With reference to FIGS. 1 and 2 for schematic circuit diagrams of a P-type AMOLED pixel circuit without compensation and an N-type AMOLED pixel circuit without compensation respectively, the current $I_{OLED}$ of an OLED is a current obtained by converting the data voltage $V_{Data}$ by using a thin-film transistor (TFT) which is the T200 as shown in FIGS. 1 and 2 in a saturated area, and its formula is $I_{OLED}=K(V_{GS}-V_{TH})^2$. After the AMOLED has been used for a long time, the $V_{TH}$ of the TFT will increase, and the carrier mobility will decrease, so that the $I_{OLED}$ will drop to cause a brightness attenuation of the AMOLED.

Due to the ageing and deterioration of the OLED, the cross voltage of the OLED will rise and the light emitting efficiency of the OLED will drop gradually after a long time of operation. The rising cross voltage of the OLED may affect the operation of the thin film transistor. The N-type thin film transistor is used for example. If the OLED is coupled to a source of the thin film transistor, and the cross voltage of the OLED rises, then the voltage source between the gate and source of the thin film transistor will be affected directly, and the current passing through will be affected directly, too. As to the light emitting efficiency, a long-time operation will cause the ageing and deterioration of the light emitting efficiency. An expected brightness cannot be achieved, even if the same current is passed through. The drop of the light emitting efficiency for three colors such as red (R), green (G) and blue (B) is different from one another, so that a color shift issue arises, and this problem is not a problem that cannot be solved easily, since the material cannot be improved easily.

As the size of the panel increases, the signal line becomes longer, and the internal resistance becomes increasingly more significant, the uniform brightness of the panel will be affected. This phenomenon is called an I-R Drop. With reference to FIG. 3 for the schematic view of the I-R Drop, the VDD and VSS signal lines will produce a voltage difference by the internal resistance effect, and different currents are passed through different pixel positions of an AMOLED panel. As a result, the uniform brightness of the panel will be affected.

SUMMARY OF THE INVENTION

In view of the problems of the prior art, it is a primary objective of the present invention to provide a compensation circuit of an organic light emitting diode to overcome the problems including the brightness attenuation, the light emitting efficiency drop and the I-R drop of the conventional OLED.

To achieve the aforementioned objective, the present invention provides a compensation circuit of an organic light emitting diode, comprising a first capacitor, a second capacitor, a stabilizer unit, a third transistor, an organic light emitting diode and a driver unit. The first capacitor has an end which is a first node, and another end which is a second node. The second capacitor is coupled to a first power supply and a first node. The stabilizer unit is coupled to a first power supply, a second power supply, a first control signal and a second control signal, and the stabilizer unit includes a first transistor, a second transistor and a photodiode. The first transistor is coupled to the second transistor with a joint which is the first node. The second transistor is coupled to the photodiode. The third transistor is coupled to the first node, a data voltage and a third control signal. The organic light emitting diode is coupled to the first power supply or the second power supply. The driver unit is coupled to the first power supply or the second power supply, the second node, the organic light emitting diode, the second control signal and a fourth control signal. The driver unit includes a fourth transistor, a fifth transistor and a sixth transistor, and an end of the fourth transistor is coupled to an end of the fifth transistor with a joint which is the second node. Another end of the fourth transistor is coupled to another end of the fifth transistor, and the sixth transistor.

Wherein, the stabilizer unit is coupled to the first power supply and the first control signal through the first transistor, and coupled to the second control signal through the second transistor, and coupled to the second power supply through the input terminal of the photodiode; the driver unit is coupled to the second control signal through the fourth transistor, and coupled to the organic light emitting diode through the fifth transistor, and the organic light emitting diode is coupled to the first power supply, and the driver unit is coupled to the fourth control signal and the second power supply through the sixth transistor.

Wherein, the first transistor, the second transistor, the third transistor, the fourth transistor, the fifth transistor and the sixth transistor are a first P-type thin film transistor, a second P-type thin film transistor, a third P-type thin film transistor, a fourth P-type thin film transistor, a fifth P-type thin film transistor and a sixth P-type thin film transistor respectively.

Wherein, the first P-type thin film transistor is used for charging the first power supply to the first node; the second P-type thin film transistor is used for controlling time for the photodiode to discharge the first node; the third P-type thin film transistor is used for controlling the time of inputting the data voltage; the fourth P-type thin film transistor stores a voltage in the first capacitor at a compensation stage; the fifth P-type thin film transistor is used for driving the organic light emitting diode; the sixth P-type thin film transistor is used for charging a voltage of the second power supply plus a voltage difference of the sixth P-type thin film transistor to the second node at an initial reset stage.

Wherein, the stabilizer unit is coupled to the second power supply and the first control signal through the first transistor, and coupled to the second control signal through the second transistor, and coupled to the first power supply through an output terminal of the photodiode; the driver unit is coupled to the second control signal through the fourth transistor, and coupled to the organic light emitting diode through the fifth transistor, and the organic light emitting diode is coupled to the second power supply, and the driver unit is coupled to the fourth control signal and the first power supply through the sixth transistor.

Wherein, the first transistor, the second transistor, the third transistor, the fourth transistor, the fifth transistor and the sixth transistor are a first N-type thin film transistor, a second N-type thin film transistor, a third N-type thin film transistor, a fourth N-type thin film transistor, a fifth N-type thin film transistor and a sixth N-type thin film transistor respectively.

Wherein, the first N-type thin film transistor is used for discharging the first node to the second power supply; the second N-type thin film transistor is used for controlling time for the photodiode to charge the first node; the third N-type thin film transistor is used for controlling time of inputting the data voltage; the fourth N-type thin film transistor stores a voltage in the first capacitor at a compensation stage; the fifth N-type thin film transistor is used for driving the organic light emitting diode; the sixth N-type thin film transistor is used for charging a voltage equal to the first power supply minus a voltage difference of the sixth N-type thin film transistor to the second node at an initial reset stage.

In summation, the compensation circuit of an organic light emitting diode of the present invention uses the voltage at the node of the control circuit to drop the light emitting efficiency of the organic light emitting diode, and uses the compensation circuit to increase the $I_{OLED}$ to provide a brighter OLED component and achieve the compensation effect, so as to maintain the brightness stability of the OLED.

DESCRIPTION OF THE PREFERRED EMBODIMENTS

Figure 1:
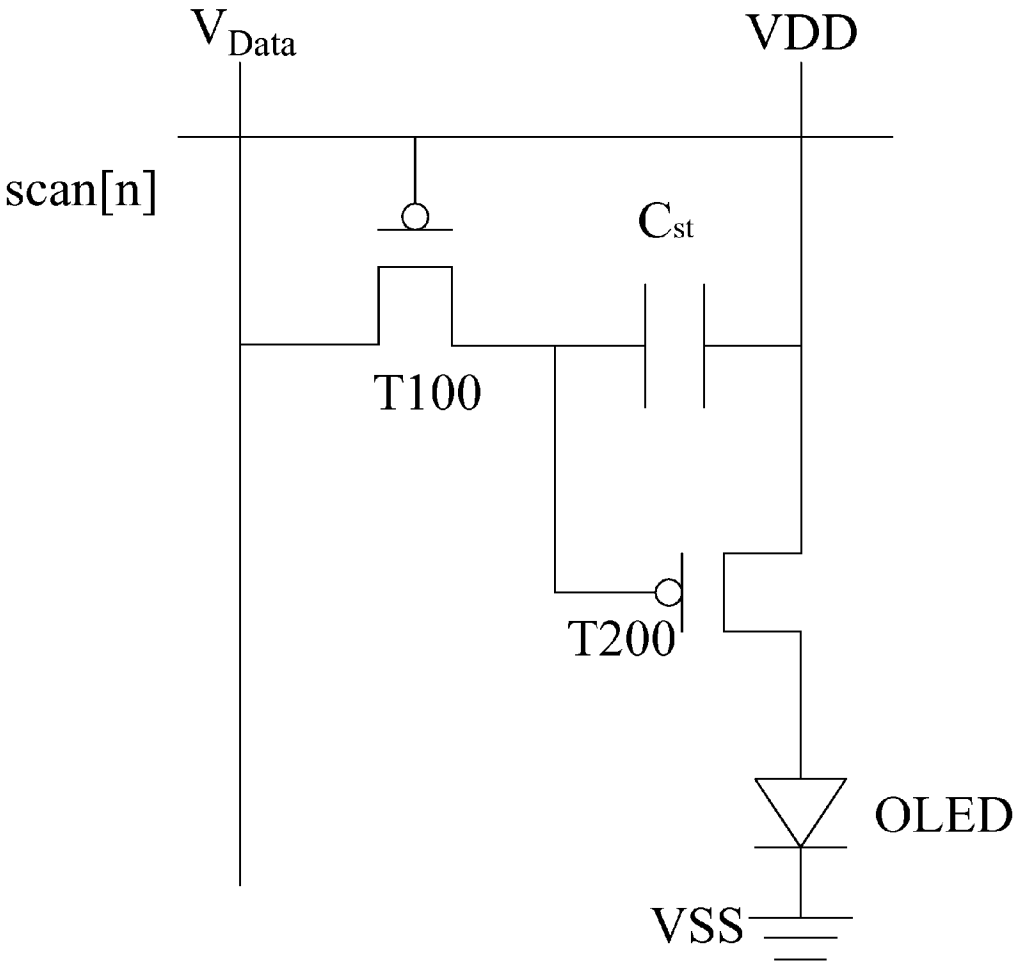
FIG. 1 (Prior Art)
FIG. 1 is a schematic circuit diagram of a P-type AMOLED pixel circuit without compensation.
Figure 2:
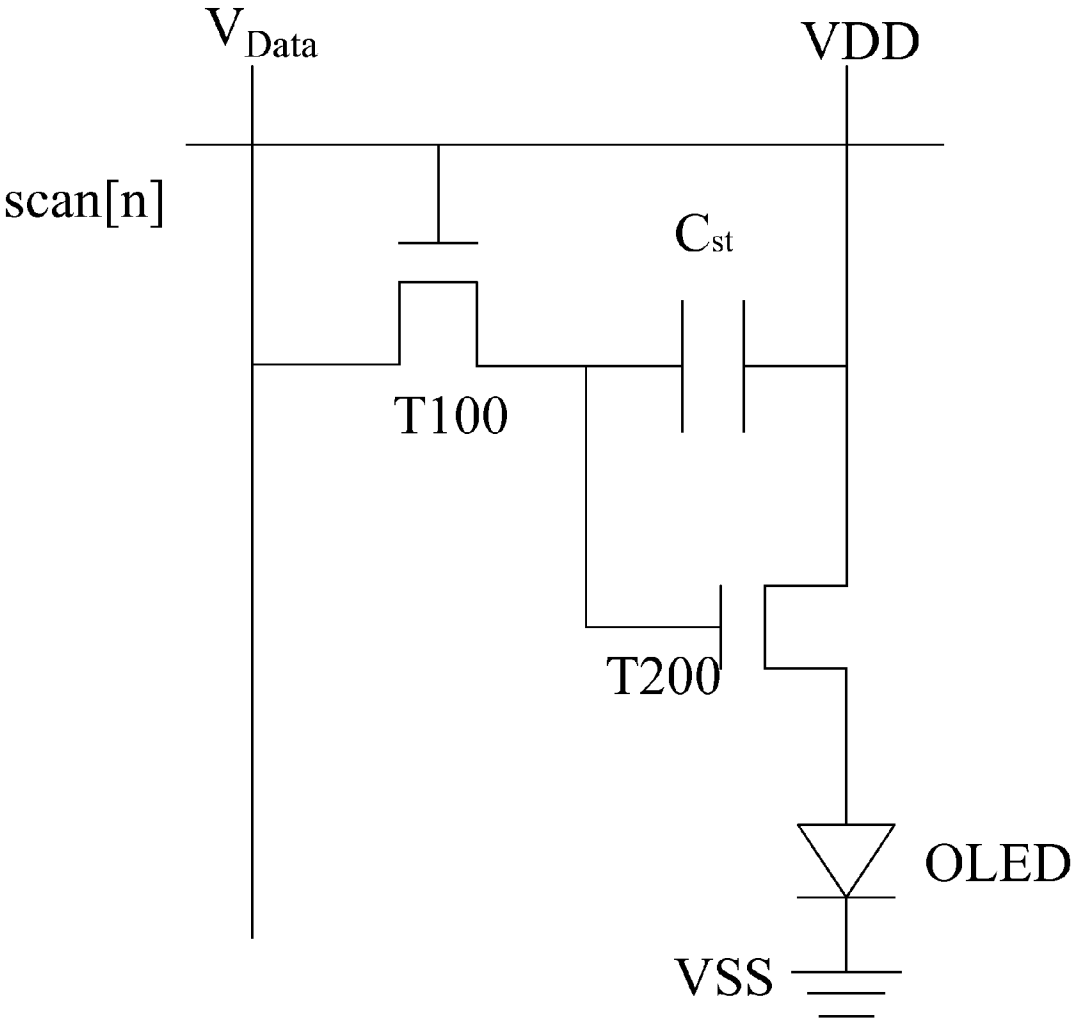
FIG. 2 (Prior Art)
FIG. 2 is a schematic circuit diagram of an N-type AMOLED pixel circuit without compensation.
Figure 3:
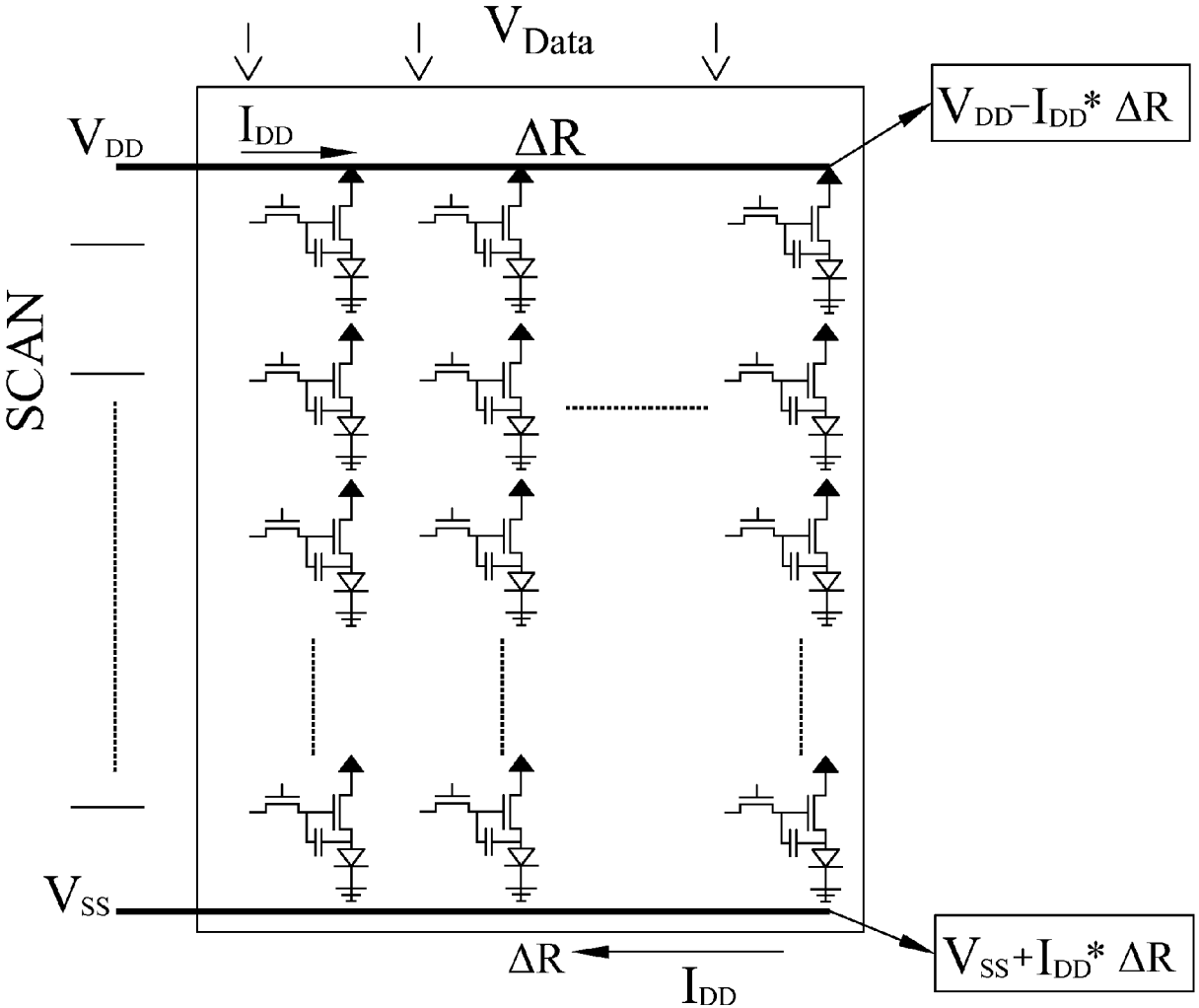
FIG. 3 (Prior Art)
FIG. 3 is a schematic view of an I-R Drop.
Figure 4:
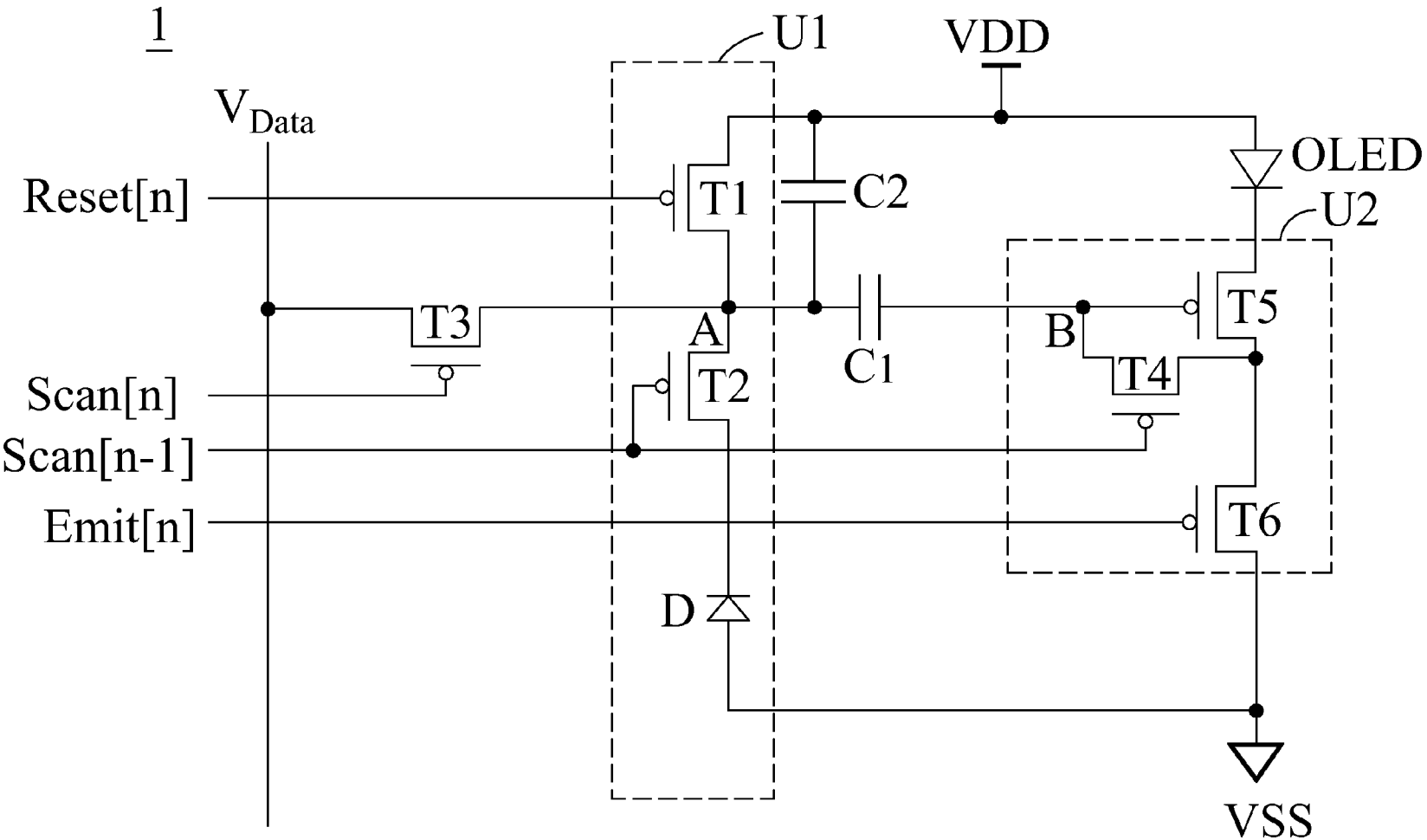
FIG. 4 is a schematic circuit diagram of a compensation circuit of an organic light emitting diode in accordance with a first preferred embodiment of the present invention.

With reference to FIG. 4 for a schematic circuit diagram of a compensation circuit of an organic light emitting diode in accordance with the first preferred embodiment of the present invention, the compensation circuit of an organic light emitting diode 1 comprises seven P-type thin film transistors, a first capacitor C1, a second capacitor C2, a first control signal Reset[n], a second control signal Scan[n-1], a third control signal Scan[n], a fourth control signal Emit[n], a data voltage $V_{Data}$, a first power signal VDD, a second power signal VSS and an OLED. In the seven P-type thin film transistors, one serves as a photodiode, and the rest serve as a first P-type thin film transistor T1, a second P-type thin film transistor T2, a third P-type thin film transistor T3, a fourth P-type thin film transistor T4, a fifth P-type thin film transistor T5 and a sixth P-type thin film transistor T6 respectively. The first P-type thin film transistor T1, second P-type thin film transistor T2 and photodiode D serve as a stabilizer unit U1, a fourth P-type thin film transistor T4, a fifth P-type thin film transistor T5 and a sixth P-type thin film transistor T6 are used as a driver unit U2. Wherein, the fifth P-type thin film transistor T5 is used for driving the OLED, and the rest T1, T2, T3, T4 and T6 are used as switches, and the first capacitor C1 is used for compensation, and the second capacitor C2 for storing the data voltage $V_{Data}$.

In all TFT used as switches, T6 is used in an initial reset stage of the second node B for resetting the second node B to $V_{TH_T6}$+VSS to facilitate conducting the T5 to perform a compensation in a later stage for the $V_{TH}$ detecting a compensation, and it is necessary to conduct the T6 for the OLED to emit light. T4 allows T5 to be able to form a diode-connection, such that the circuit at the compensation stage can produce a $V_{TH}$ value of the T6 to be saved in the first capacitor (compensation capacitor) C1. T3 is a switch generally installed in a pixel circuit and provided for controlling the time of inputting the data voltage $V_{Data}$. T1 is turned off after pre-charging the first node A to VDD at the initial reset stage of the first node A. T2 controls the charging time for the photodiode D to discharge the first node A.

Figure 5:
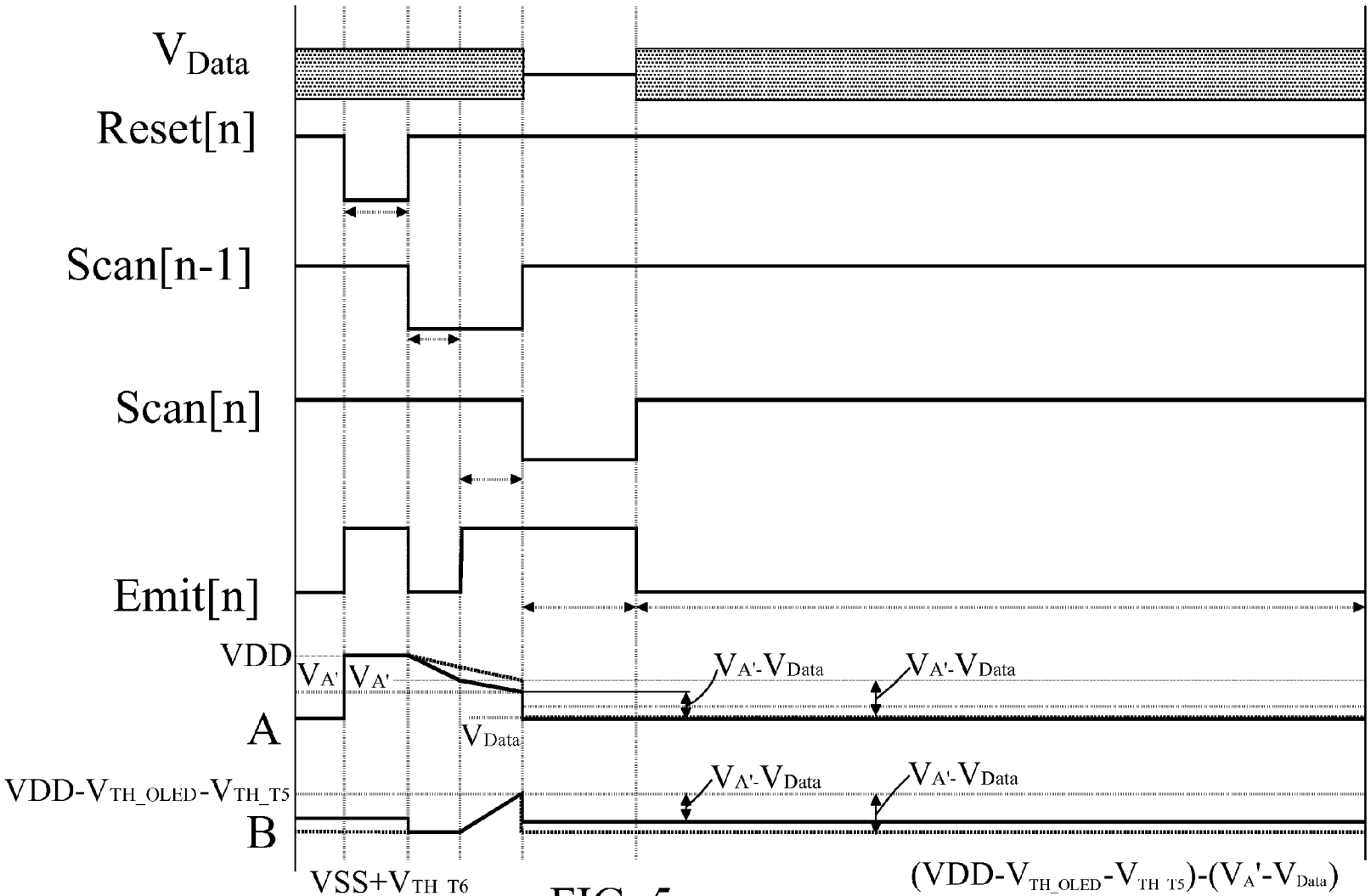
FIG. 5 is a waveform chart of signals of a compensation circuit of an organic light emitting diode in accordance with the first preferred embodiment of the present invention.

With reference to FIG. 5 for a waveform chart of signals of a compensation circuit of an organic light emitting diode in accordance with the first preferred embodiment of the present invention, the circuit operation of the compensation circuit of an organic light emitting diode 1 is divided into the following five stages.

1. Initial reset stage of the first node A: Reset[n] signal is Low, T1 is ON, and the first node A is pre-charged to VDD.

2. Initial reset stage of the second node B: Reset[n] signal is pulled High, T1 is OFF, Scan[n-1] and Emit[n] signals are switched to Low, T2, T4, T5 and T6 are ON, and the second node B is initialized to $V_{TH_T6}$+VSS. In the meantime, the first node A is charged through the T2 and the photodiode D, and the discharged current depends on the brightness of OLED components.

3. $V_{TH}$ detecting compensation stage: Scan[n-1] signal is maintained at Low, Emit[n] signal is pulled High, T6 is OFF, T2, T4 and T5 are still ON, the voltage of the second node B is charged to $VDD-V_{TH_OLED}-V_{TH_T5}$, so that the T5 is switched from the ON state to the OFF state, the voltage of the second node B are kept at $VDD-V_{TH_OLED}-V_{TH_T5}$ to complete the $V_{TH}$ compensation. In addition, the first node A continues its discharge through the T2 and the photodiode D, and the discharged current depends on the brightness of OLED components.

4. Writing in the pixel data voltage stage:

Scan[n-1] signal is pulled High, Scan[n] is switched to Low, T2 and T4 are OFF, T3 is ON, the pixel data voltage is written in, the second node B is at a floating state, the voltage of the first node A is changed from $V_{A'}$ to $V_{Data}$, and its variation is $V_{Data}-V_{A'}$ (which is a negative value), the second node B is changed to $(VDD-V_{TH_OLED}-V_{TH_T5})-(V_{A'}-V_{Data})$ by the capacitance coupling effect of the first node A.

5. OLED light emission display stage:

Scan[n] is switched to High, Emit[n] signal is pulled Low, T3 is OFF, T6 is ON, the current for conducting the T5 for driving the OLED depends on the light emitting brightness of the OLED, $V_{Gate_T5}=VB=(VDD-V_{TH_OLED}-V_{TH_T5})-(V_{A'}-V_{Data})$, $V_{source_T5}=VDD-V_{OLED}=VDD-[V_{TH_OLED}+V(f(V_{Data}))]$, $V(f(V_{Data}))$ is the increased cross voltage which is a function of the written-in data voltage $V_{Data}$, when the OLED component emits light, and will not vary with the light emitting efficiency of the OLED component. $I_{OLED}=\beta/2*(V_{SG_T5}-|V_{TH_T5}|)^2=\beta/2*[(V_{A'}-V_{Data})-V(f(V_{Data}))]^2$. If the light emitting efficiency of the OLED component drops, the current of the photodiode D also drops, and $V_{A'}$ becomes larger, such that $I_{OLED}$ also increases to provide a brighter OLED component and achieve the compensation effect.

As to the I-R Drop, observations show that the pixels of the AMOLED at the input terminal and situated away from the VDD, VSS signals have a change of VDD, VSS to VDD−I*R, VSS+I*R. In other words, the first node A will pre-charge to a lower potential of VDD−I*R, and then the photodiode D is provided for discharging to a higher potential of VSS+I*R. In other words, the cross voltage of the photodiode D decreases, and the discharged current of the first node A also decreases, such that the $V_{A'}$ not decrease too much due to the I-R Drop to achieve the effect of compensating the I-R Drop.

Figure 6:
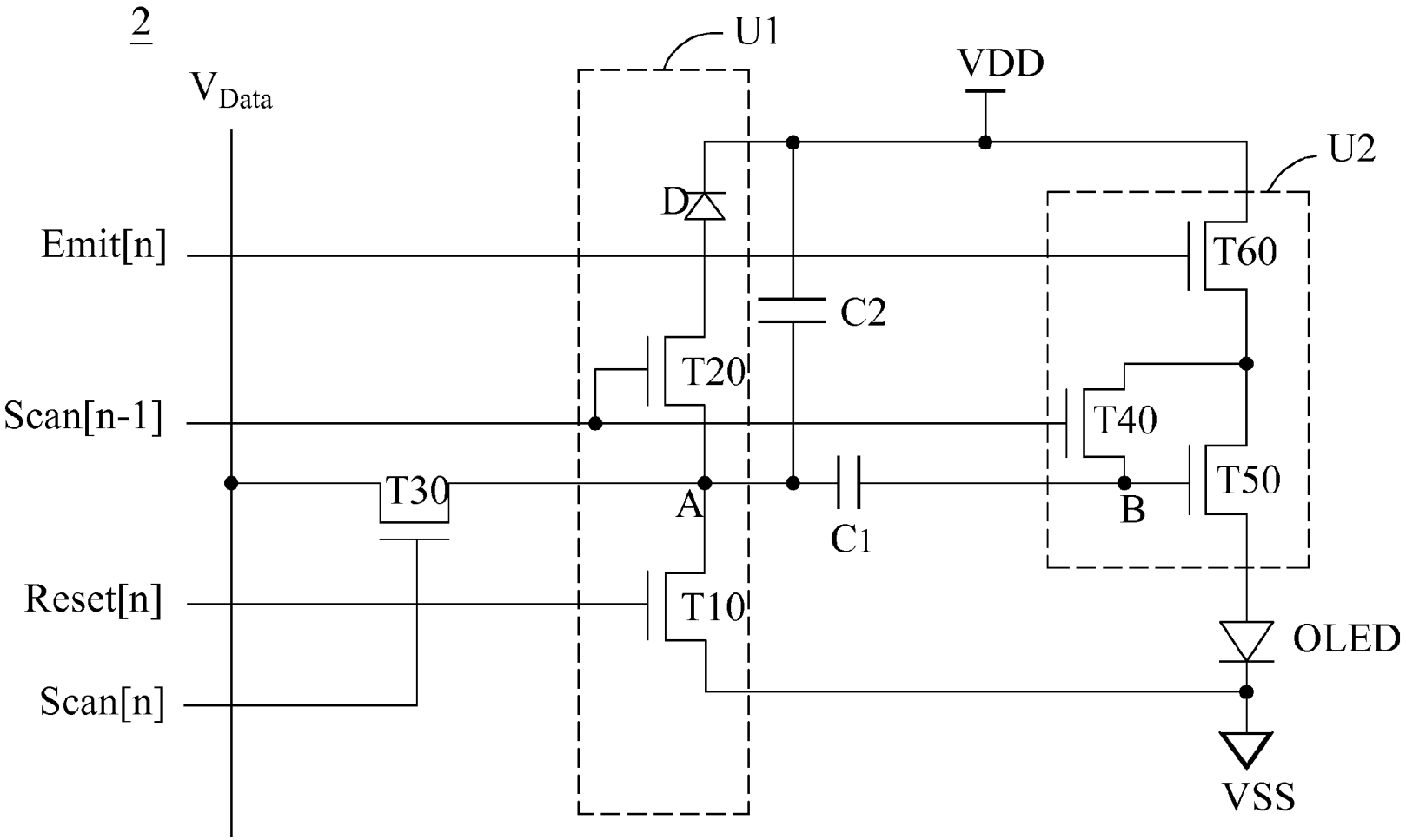
FIG. 6 is a schematic circuit diagram of a compensation circuit of an organic light emitting diode in accordance with a second preferred embodiment of the present invention.

With reference to FIG. 6 for a schematic circuit diagram of a compensation circuit of an organic light emitting diode in accordance with a second preferred embodiment of the present invention, the compensation circuit of an organic light emitting diode 2 comprises seven N-type thin film transistors, a first capacitor C1, a second capacitor C2, a first control signal Reset[n], a second control signal Scan[n-1], a third control signal Scan[n], a fourth control signal Emit[n], a data voltage $V_{Data}$, a first power signal VDD, a second power signal VSS and OLED. The seven N-type thin film transistors, wherein one is used as a photodiode D, and the rest are a first N-type thin film transistor T10, a second N-type thin film transistor T20, a third N-type thin film transistor T30, a fourth N-type thin film transistor T40, a fifth N-type thin film transistor T50 and a sixth N-type thin film transistor T60, a first N-type thin film transistor T10, a second N-type thin film transistor T20 and a photodiode D are considered as a stabilizer unit U1, and the fourth N-type thin film transistor T40, the fifth N-type thin film transistor T50 and the sixth N-type thin film transistor T60 are considered as a driver unit U2. Wherein, the T50 is used as a driving OLED, and the rest are T10, T20, T30, T40 and T60 are used as switches, and the first capacitor C1 is used for compensation, and the second capacitor C2 is used for storing a data voltage $V_{Data}$.

In all TFT used as switches, the T60 is used for resetting the second node B to $VDD-V_{TH_T60}$ at the initial reset stage of the second node B, so that the T50 is conducted to perform the compensation in a later $V_{TH}$ detection compensation stage, and it is also necessary to conduct the T60 when the OLED emits light. The T40 is provided for the T50 to form a diode-connection to produce a $V_{TH}$ value of the T50 and stores the $V_{TH}$ value in the first capacitor (compensation capacitor) C1 at the compensation stage of the circuit. The T30 is a switch generally installed in a pixel circuit and provided for controlling the time of inputting the data voltage $V_{Data}$. The T10 is turned off after the first node A is pre-charged to VSS at the initialization stage of the first node A. The T20 controls time for the photodiode D to charge the first node A.

Figure 7:
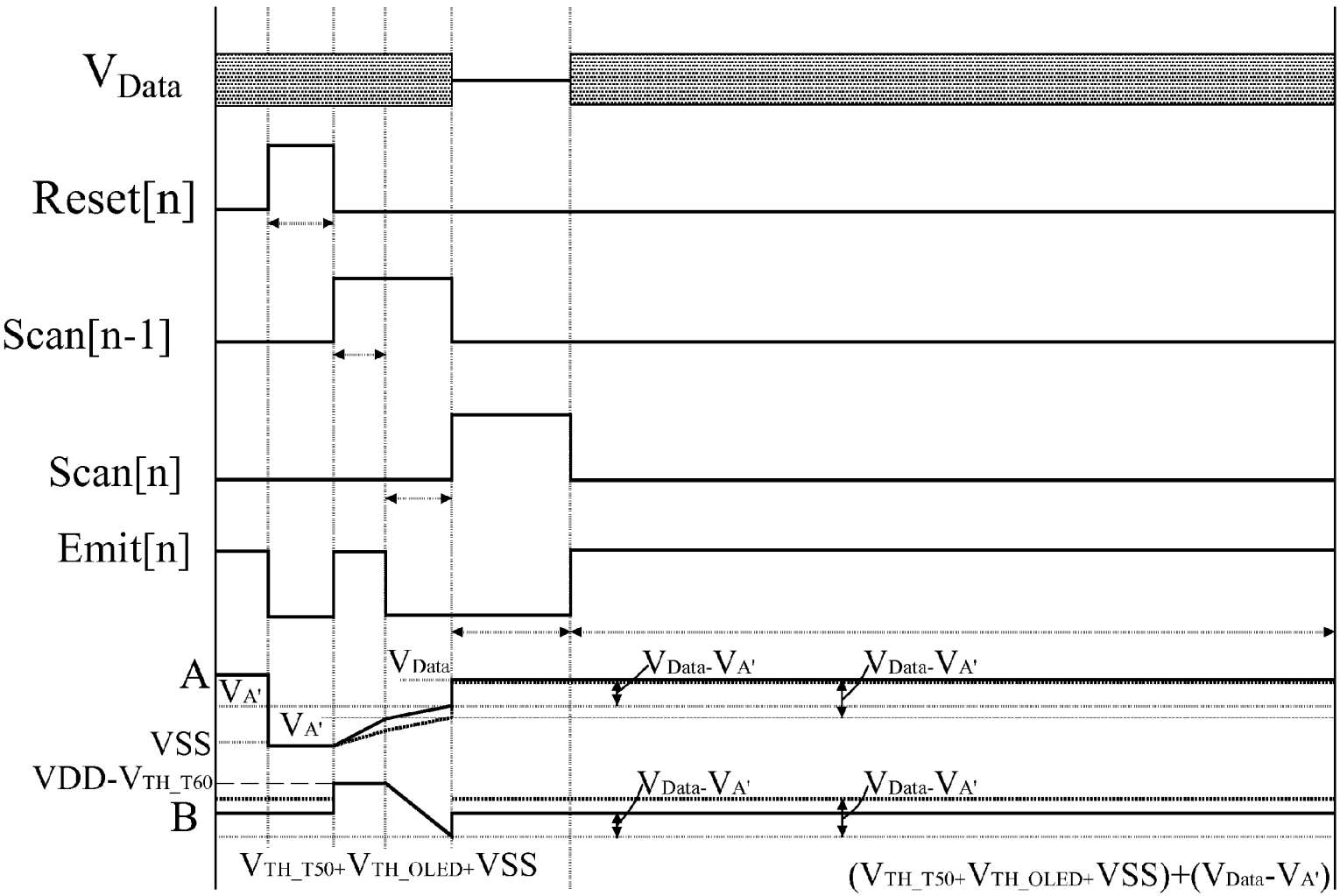
FIG. 7 is a waveform chart of signals of a compensation circuit of an organic light emitting diode in accordance with the second preferred embodiment of the present invention.

With reference to FIG. 7 for a waveform chart of signals of a compensation circuit of an organic light emitting diode in accordance with the second preferred embodiment of the present invention, the operation procedure of the compensation circuit of an organic light emitting diode 2 is divided into the following five stages.

1. Initial reset stage of the first node A: Reset[n] signal is High, T10 is ON, the first node A is pre-charged to VSS.

2. Initial reset stage of the second node B: Reset[n] signal is pulled Low, T10 is OFF, Scan[n-1] and Emit[n] signals are switched to High, the T20, T40, T50 and T60 are ON, the second node B is initialized to $VDD-V_{TH_T60}$. In the meantime, the first node A is charged through the T20 and the photodiode D, and the charged current depends on the brightness of OLED components.

3. $V_{TH}$ detecting compensation stage:

Scan[n-1] signal is maintained at High, Emit[n] signal is pulled Low, T60 is OFF, T20, T40 and T50 are ON, the voltage of the second node B is discharged to $V_{TH_T50}+V_{TH_OLED}+VSS$, so that the T50 is changed from the ON state to the OFF state, the voltage of the second node B is maintained at $V_{TH_T50}+V_{TH_OLED}+VSS$, so as to complete the $V_{TH}$ compensation. In addition, the first node A is charged continuously through the T20 and the photodiode D, and the charged current depends on the brightness of OLED components.

4. Writing in pixel data voltage stage:

Scan[n-1] signal is pulled Low, Scan[n] is switched to High, T20 and T40 are OFF, T30 is ON, the pixel data voltage is written in, and now, the second node B is situated at a floating state, the first node A voltage changes from $V_{A'}$ to $V_{Data}$, and the change is equal to $V_{Data}-V_{A'}$ which is a positive value, and the second node B is changed to $(V_{TH_T50}+V_{TH_OLED}+VSS)+(V_{Data}-V_{A'})$ by the capacitance coupling effect of the first node A.

5. OLED light emitting display stage:

Scan[n] is switched to Low, Emit[n] signal is pulled High, T30 is OFF, T60 is On, the T50 of the OLED is driven and whose conductive current determines the light emitting brightness of the OLED, and $V_{Gate_T50}=VB=(V_{TH_T50}+V_{TH_OLED}+VSS)+(V_{Data}-V_{A'})$, $V_{source_T50}=V_{OLED}+VSS=V_{TH_OLED}+V(f(V_{Data}))+VSS$, $V(f(V_{Data}))$ are the increased cross voltage (which is a function of the written-in data voltage) when the OLED components emit light, and this cross-voltage will not vary with the light emitting efficiency of the OLED component. $I_{OLED}=\beta/2*(V_{GS_T50}-V_{TH_T50})2=\beta/2*(V_{Data}-V_{A'}-V(f(V_{Data}))2$. When the light emitting efficiency of the OLED component drops, the current of the photodiode D will also drop to decrease the $V_{A''}$. Therefore, the current $I_{OLED}$ of the organic light emitting diode becomes larger to provide a brighter OLED component and achieve the compensation effect.

As to the I-R Drop, observations show that the pixels of the AMOLED at the input terminal and situated away from the VDD, VSS signals have a change of VDD, VSS to VDD−I*R, VSS+I*R. In other words, the first node A will pre-charge to a lower potential of VDD−I*R, and then the photodiode D is provided for discharging to a lower potential of VSS+I*R. In other words, the cross voltage of the photodiode D decreases, and the discharged current of the first node A also decreases, such that the $V_A$ will not decrease too much due to the I-R Drop to achieve the effect of compensating the I-R Drop.

Figure 8:
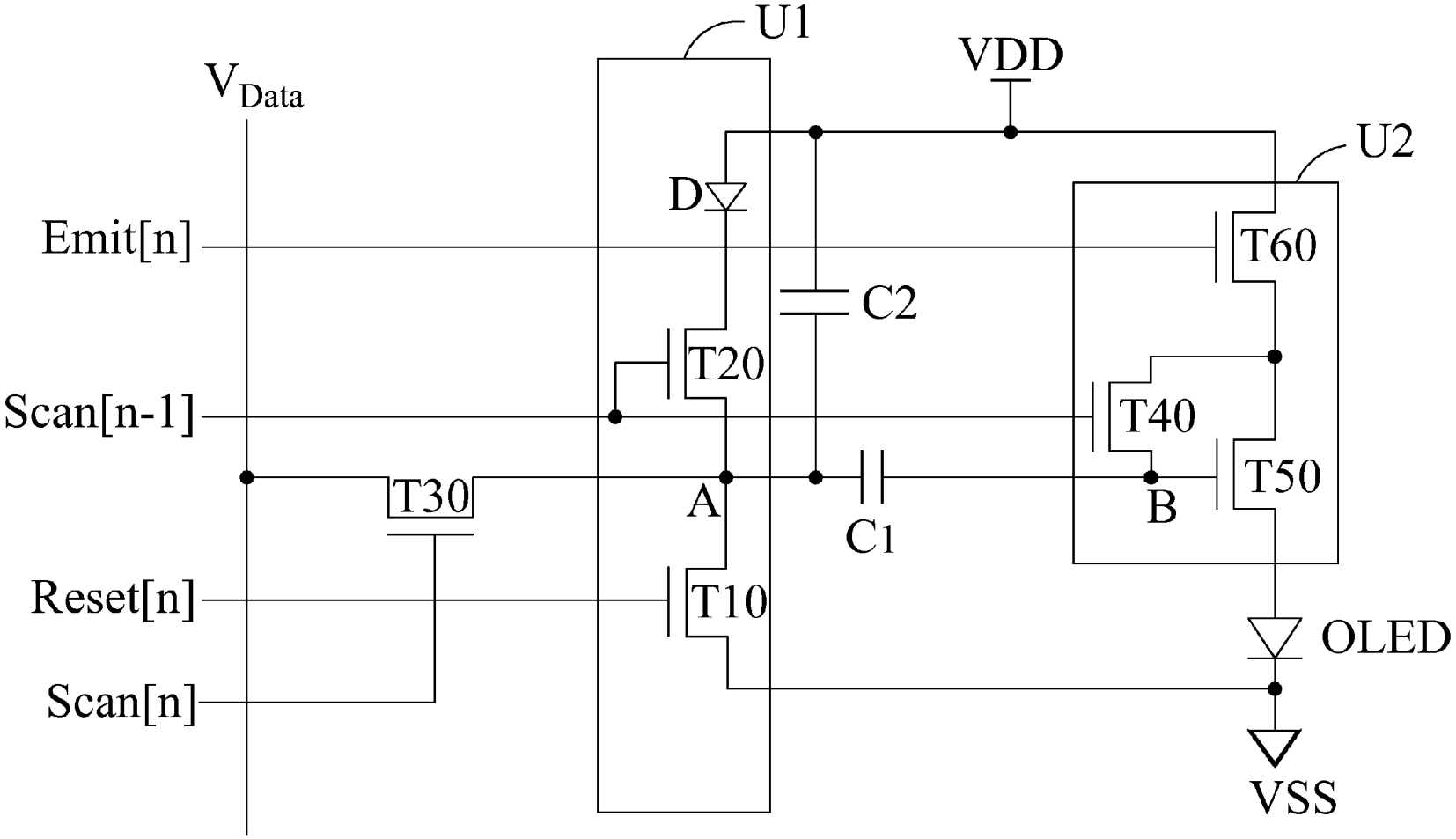
FIG. 8 is a first schematic circuit diagram, showing a change of circuit in the compensation circuit of an organic light emitting diode in accordance with the second preferred embodiment of the present invention.
Figure 9:
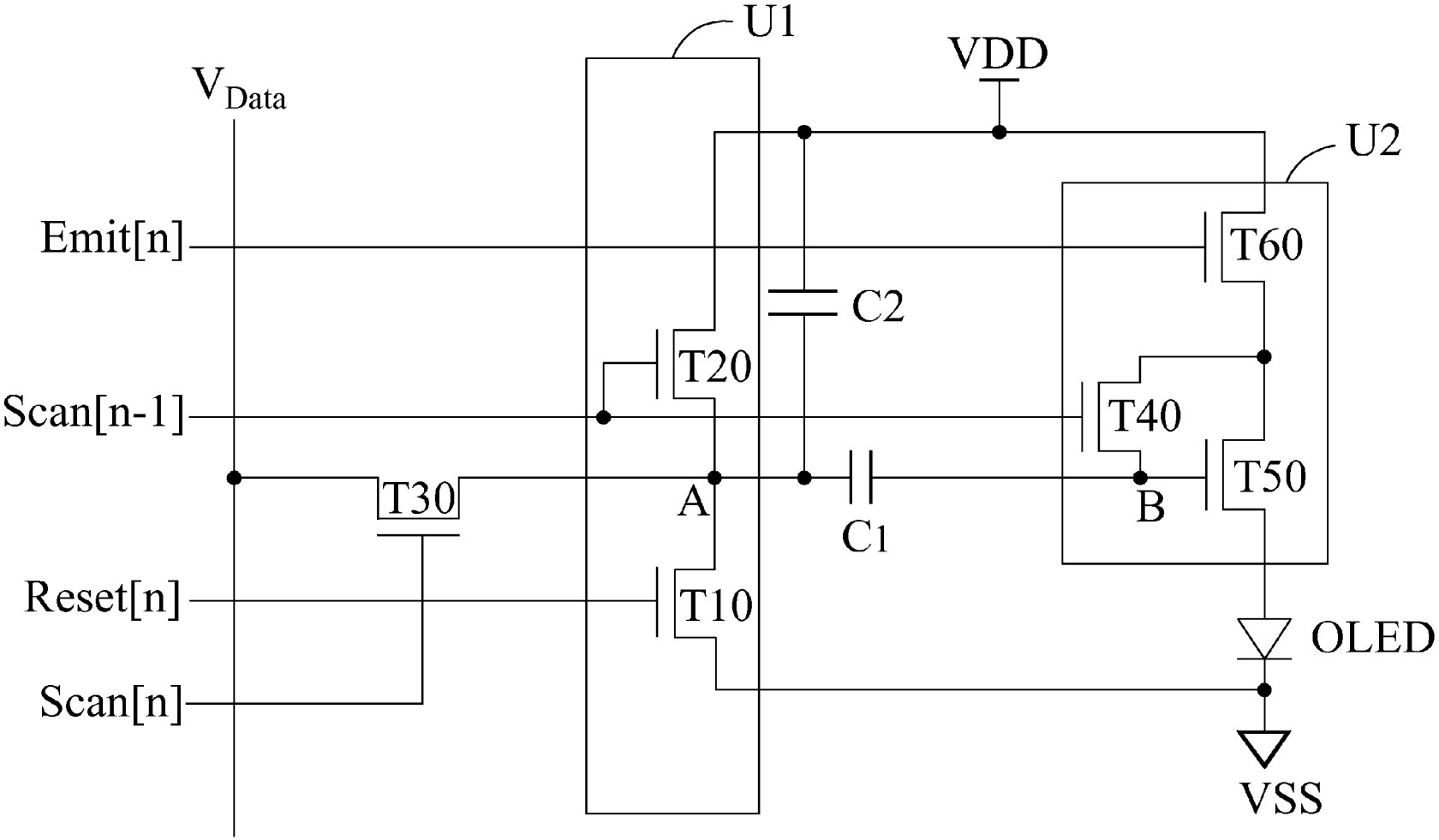
FIG. 9 is a second schematic circuit diagram, showing a change of circuit in the compensation circuit of an organic light emitting diode in accordance with the second preferred embodiment of the present invention.

With reference to FIGS. 8 and 9 for the first and second schematic circuit diagrams showing a change of circuit in the compensation circuit of an organic light emitting diode in accordance with the second preferred embodiment of the present invention respectively, the circuit as shown in FIG. 8 adopts a smaller forward-bias photodiode D to substitute the reverse-bias photodiode. In the circuit as shown in FIG. 9, the photodiode D and the second N-type thin film transistor T20 are reduced to a photo switch.

In summation of the description above, the compensation circuit of an organic light emitting diode of the present invention can overcome the problems of a conventional OLED with the brightness attenuation, the light emitting efficiency drop and the I-R Drop.

What is claimed is:

1. A compensation circuit of an organic light emitting diode, comprising:

a first capacitor having an end being a first node, and another end being a second node;

a second capacitor coupled to a first power supply and the first node;

a stabilizer unit coupled to the first power supply, a second power supply, a first control signal and a second control signal, and the stabilizer unit including a first transistor, a second transistor and a photodiode, and the first transistor being coupled to the second transistor with a joint thereof being the first node, and the second transistor being coupled to the photodiode;

a third transistor coupled to the first node, a data voltage and a third control signal;

an organic light emitting diode coupled to the first power supply or the second power supply; and a driver unit coupled to the first power supply or the second power supply, the second node, the organic light emitting diode, the second control signal and a fourth control signal, and the driver unit including a fourth transistor, a fifth transistor and a sixth transistor, and an end of the fourth transistor being coupled to an end of the fifth transistor with a joint thereof being the second node, and another end of the fourth transistor being coupled to another end of the fifth transistor and the sixth transistor.

2. The compensation circuit of an organic light emitting diode as recited in claim 1, wherein the stabilizer unit is coupled to the first power supply and the first control signal through the first transistor, and coupled to the second control signal through the second transistor, and coupled to the second power supply through an input terminal of the photodiode; the driver unit is coupled to the second control signal through the fourth transistor, and coupled to the organic light emitting diode through the fifth transistor, and the organic light emitting diode is coupled to the first power supply, and the driver unit is coupled to the fourth control signal and the second power supply through the sixth transistor.

3. The compensation circuit of an organic light emitting diode as recited in claim 2, wherein the first transistor, the second transistor, the third transistor, the fourth transistor, the fifth transistor and the sixth transistor are a first P-type thin film transistor, a second P-type thin film transistor, a third P-type thin film transistor, a fourth P-type thin film transistor, a fifth P-type thin film transistor and a sixth P-type thin film transistor, respectively.

4. The compensation circuit of an organic light emitting diode as recited in claim 3, wherein the first P-type thin film transistor has a source coupled to the first power supply; a gate coupled to the first control signal; and a drain coupled to the first node, a source of the second P-type thin film transistor and a drain of the third P-type thin film transistor.

5. The compensation circuit of an organic light emitting diode as recited in claim 3, wherein the second P-type thin film transistor has a source coupled to the first node, a drain of the first P-type thin film transistor and a drain of the third P-type thin film transistor; a gate coupled to the second control signal; and a drain coupled to an output terminal of the photodiode.

6. The compensation circuit of an organic light emitting diode as recited in claim 3, wherein the third P-type thin film transistor has a source coupled to the data voltage; a gate coupled to the third control signal; and a drain coupled to the first node, a drain of the first P-type thin film transistor and a source of the second P-type thin film transistor.

7. The compensation circuit of an organic light emitting diode as recited in claim 3, wherein the fourth P-type thin film transistor has a source coupled to the second node and a gate of the fifth P-type thin film transistor; a gate coupled to the second control signal; and a drain coupled to a drain of the fifth P-type thin film transistor and a source of the sixth P-type thin film transistor.

8. The compensation circuit of an organic light emitting diode as recited in claim 3, wherein the fifth P-type thin film transistor has a source coupled to an output terminal of the organic light emitting diode, and the input terminal of the organic light emitting diode is coupled to the first power supply; a gate coupled to the second node and a source of the fourth P-type thin film transistor; and a drain coupled to a drain of the fourth P-type thin film transistor and a source of the sixth P-type thin film transistor.

9. The compensation circuit of an organic light emitting diode as recited in claim 3, wherein the sixth P-type thin film transistor has a source coupled to a drain of the fourth P-type thin film transistor and a drain of the fifth P-type thin film transistor; a gate coupled to the fourth control signal; and a drain coupled to the second power supply.

10. The compensation circuit of an organic light emitting diode as recited in claim 3, wherein the first P-type thin film transistor is used for charging the first power supply to the first node; the second P-type thin film transistor is used for controlling time for the photodiode to discharge the first node; the third P-type thin film transistor is used for controlling time of inputting the data voltage; the fourth P-type thin film transistor stores a voltage in the first capacitor at a compensation stage; the fifth P-type thin film transistor is used for driving the organic light emitting diode; the sixth P-type thin film transistor is used for charging a voltage of the second power supply plus a voltage difference of the sixth P-type thin film transistor to the second node at an initial reset stage.

11. The compensation circuit of an organic light emitting diode as recited in claim 1, wherein the stabilizer unit is coupled to the second power supply and the first control signal through the first transistor, and coupled to the second control signal through the second transistor, and coupled to the first power supply through an output terminal of the photodiode; the driver unit is coupled to the second control signal through the fourth transistor, and coupled to the organic light emitting diode through the fifth transistor, and the organic light emitting diode is coupled to the second power supply, and the driver unit is coupled to the fourth control signal and the first power supply through the sixth transistor.

12. The compensation circuit of an organic light emitting diode as recited in claim 11, wherein the first transistor, the second transistor, the third transistor, the fourth transistor, the fifth transistor and the sixth transistor are a first N-type thin film transistor, a second N-type thin film transistor, a third N-type thin film transistor, a fourth N-type thin film transistor, a fifth N-type thin film transistor and a sixth N-type thin film transistor, respectively.

13. The compensation circuit of an organic light emitting diode as recited in claim 12, wherein the first N-type thin film transistor has a source coupled to the second power supply; a gate coupled to the first control signal; and a drain coupled to the first node, a source of the second N-type thin film transistor, and a source of the third N-type thin film transistor.

14. The compensation circuit of an organic light emitting diode as recited in claim 12, wherein the second N-type thin film transistor has a source coupled to the first node, a drain of the first N-type thin film transistor and a source of the third N-type thin film transistor; the second N-type thin film transistor has a gate coupled to the second control signal; and a drain of the second N-type thin film transistor is coupled to an input terminal of the photodiode.

15. The compensation circuit of an organic light emitting diode as recited in claim 12, wherein the third N-type thin film transistor has a drain coupled to the data voltage; a gate coupled to the third control signal; and a source coupled to the first node, a drain of the first N-type thin film transistor and a source of the second N-type thin film transistor.

16. The compensation circuit of an organic light emitting diode as recited in claim 12, wherein the fourth N-type thin film transistor has a source coupled to the second node and a gate of the fifth N-type thin film transistor; and a gate coupled to the second control signal; and a drain coupled to a drain of the fifth N-type thin film transistor and a source of the sixth N-type thin film transistor.

17. The compensation circuit of an organic light emitting diode as recited in claim 12, wherein the fifth N-type thin film transistor has a drain coupled to a drain of the fourth N-type thin film transistor and a source of the sixth N-type thin film transistor; a gate coupled to the second node and a source of the fourth N-type thin film transistor; and a source coupled to an input terminal of the organic light emitting diode, and the output terminal of the organic light emitting diode is coupled to the second power supply.

18. The compensation circuit of an organic light emitting diode as recited in claim 12, wherein the sixth N-type thin film transistor has a source coupled to a drain of the fourth N-type thin film transistor and a drain of the fifth N-type thin film transistor; a gate coupled to the fourth control signal; and a drain coupled to the first power supply.

19. The compensation circuit of an organic light emitting diode as recited in claim 12, wherein the first N-type thin film transistor is used for discharging the first node to the second power supply; the second N-type thin film transistor is used for controlling time for the photodiode to charge the first node; the third N-type thin film transistor is used for controlling time of inputting the data voltage; the fourth N-type thin film transistor stores a voltage in the first capacitor at a compensation stage; the fifth N-type thin film transistor is used for driving the organic light emitting diode; the sixth N-type thin film transistor is used for charging a voltage equal to the first power supply minus a voltage difference of the sixth N-type thin film transistor to the second node at an initial reset stage.

* * * * *